US007214003B1

(12) United States Patent
Lux, III

(10) Patent No.: US 7,214,003 B1
(45) Date of Patent: May 8, 2007

(54) SEGMENTAL FLOATING BULKHEAD ASSEMBLY

(76) Inventor: Frederick Lux, III, 2211 E. Clairemont Ave., Suite 4, Eau Claire, WI (US) 54702-8153

( * ) Notice: Subject to any disclaimer, the term of this patent is extended or adjusted under 35 U.S.C. 154(b) by 0 days.

(21) Appl. No.: 10/198,780

(22) Filed: Jul. 18, 2002

(51) Int. Cl.
*E02B 7/26* (2006.01)

(52) U.S. Cl. ..... 405/104; 405/111; 405/114

(58) Field of Classification Search ..... 405/23, 405/26, 64, 66, 67, 71, 103, 104, 107, 111, 405/114
See application file for complete search history.

(56) References Cited

U.S. PATENT DOCUMENTS

| | | | | |
|---|---|---|---|---|
| 3,335,572 | A | 8/1967 | Tsujioka | |
| 3,534,558 | A * | 10/1970 | Le Bouteiller | 405/26 |
| 3,640,075 | A * | 2/1972 | La Peyre | 405/23 |
| 3,969,900 | A * | 7/1976 | Plodowski | 405/23 |
| 4,259,028 | A * | 3/1981 | Cook | 405/272 |
| 4,729,692 | A | 3/1988 | Tucker | |
| 5,634,742 | A | 6/1997 | Mills | |
| 6,004,067 | A * | 12/1999 | Peppard | 405/52 |

OTHER PUBLICATIONS

James Hitt, "Sticky Wickets—Bulkhead Built for Spill Gate Rehabilitation Project.", Hydro Review, Jun. 1994, vol. XIII, No. 3, pp. 66 and 67.

William H. Riddle, "Spillway Dewatering for Replacement of Radial Crest Gates", Proceedings: Waterpower '95, Jul. 1995, pp. 2694-2703, American Society of Civil Engineers (ASCE), San Francisco, California.

"Big bulkhead hauled ashore.", Engineering News Record, May 17, 1993, p. 22.

Chandler K. Sehgal, Michael J. Morgan and Frank Reece, "Replacement of Draft Tube Floating Caisson and Handling system at the Wilson Hydroelectric Plant", Proceedings: Waterpower '95, Jul. 1995, pp. 2608-2619, American Society of Civil Engineers (ASCE), San Francisco, California.

Raymond O Ellis, Dana M. Jeske and Peter J. Christensen, "Wanapum Dam Spillway Overflow Gate", Proceedings: Waterpower '97, Jul. 1997, pp. 579-580, American Society of Civil Engineers (ASCE), San Francisco, California.

Aswan High Dam, Draft Tube Bulkhead, May 7, 1991, Drawing Nos. OA-42-91 through OA-42-101, Sheets 1 through 11, U.S. Bureau of Reclamation.

Broken Bow Lake, Stop Log/Bulkhead System, Sep. 30, 1995, Sheet Nos. S-1, S-2 and S-13, U.S. Army Corps of Engineers, Tulsa District.

Michael Mills, "Corps Develops New Stoplog/Bulkhead System", Hydro Review, Dec. 1997, vol. XVI, No. 7, pp. 74 and 75.

Karen Strotiak, "Sticky Wickets-Floating Bulkhead Proves Flexible, Reusable", Hydro Review, Jun. 1987, vol. VI, No. 3, pp. 62 and 63.

(Continued)

*Primary Examiner*—Michael Safavi
(74) *Attorney, Agent, or Firm*—Anthony J. Bourget

(57) ABSTRACT

The present invention is directed to the structure of a floatable caisson member and to a segmental floatable bulkhead assembly, formed by assembling a plurality of the floatable caisson members. The present invention also includes a method of fabrication of the floatable caisson member. A segmental floatable bulkhead assembly, formed by assembling a plurality of the floatable caisson members, is employed for dewatering a water passage of a dam.

70 Claims, 8 Drawing Sheets

OTHER PUBLICATIONS

Karen Strotiak, "Dam Renovation—Hinged Floating Bulkhead Proves Flexible, Reusable", Trends, a Publication of Ayres Associates, Autumn 1987, pp. 2 and 3.
James R. Bakken and John S. Vonasek, Floating Bulkhead Installed for Hydro Intake Repair, Proceedings: Small Hydro '88, Jul. 1988, preprint version consisting of 13 pages of text and 5 pages of figures, Ministry of Energy, Toronto, Canada.
Frederick Lux III and Eric P. Regner, "Dewatering Using a Floating Bulkhead Proves Flexible, Reusable and Cost Effective", Proceedings: Waterpower '91, Jul. 1991, pp. 1843-1852, American Society of Civil Engineers (ASCE), Denver, Colorado.
Martin Hendricks, "The Dam Door That Saved a Bundle", Wisconsin Engineering Journal, 1992, pp. 18 and 19.
Frederick Lux III and Eric P. Regner, "Dewatering Using a Floating Bulkhead Proves Flexible, Reusable and Cost Effective", USBR Water Operation and Maintenance, Bulletin No. 162, Dec. 1992, pp. 34-42.
Frederick Lux III and James R. Bakken, "An Innovative Concept for Dewatering Hydro Plants", Hydro Review, Dec. 1992, vol. XI, No. 7, pp. 72-79, (Reprint).
Richard M. Rudolph and John R. Kries, "Considerations for Dewatering Hydro Units and Gates", Proceedings: Waterpower '93, Aug. 1993, pp. 1812-1821, American Society of Civil Engineers (ASCE), Nashville, Tennessee (Preprint).
Frederick Lux III, Richard M. Rudolph and Richard K. Frithiof, "Closure Methods for Large Intakes", Proceedings: Waterpower '95, Jul. 1995, pp. 2085-2094, San Francisco, California (Preprint).
Frederick Lux III, James R. Bakken and John A. Kolson, "Economical Dewatering Methods for Spillways and Intakes", Proceedings, 1996 Annual Conference, Sep. 1996, pp. 137-146, Association of State Dam Safety Officials, Seattle, Washington.
Frederick Lux III, Richard M. Rudolph and Richard K. Frithiof, "Taking in the River", Civil Engineering, Jul. 1997, pp. 51-54.
Richard M. Rudolph, Robert F. Martin, Frederick Lux III and Todd M. Rudolph, "A Dam Owner's Tool—The Hinged Floating Bulkhead", Proceedings, 1998 Annual Conference, Oct. 1999, pp. 137-146, Association of State Dam Safety Officials, Las Vegas, Nevada.
Richard M. Rudolph, Robert F. Martin, Frederick Lux III and Todd Rudolph, "Dewatering intakes with a hinged floating bulkhead", Hydropower & Dams, 1999, Issue 3, pp. 47-50.
Floating Bulkhead General Arrangement and others, Nickajack Project Jun. 12, 1974, Drawing Nos. 54W230 through 54W235, Tennessee Valley Authority.
Floating Bulkhead General Arrangement, Melton Hill Project, Nov. 15, 1976, Drawing No. 54E230, Tennessee Valley Authority.
Floating Bulkhead General Arrangement and others, Nickajack Project Jun. 12, 1974, Drawing Nos. 54W230 through 54W235, Tennessee Valley Authority, previously submitted.
Floating Bulkhead General Arrangement, Melton Hill Project, Nov. 15, 1976, Drawing No. 54E230, Tennessee Valley Authority, previously submitted.
Color photograph of Melton Hill Project in drawing No. 54E230, Nov. 15, 1976, Tennessee Valley Authority, (photo taken circa 2002, courtesy of Tennessee Valley Authority, previously submitted.
Color photograph of same Melton Hill project shown in drawing No. 54E230, Nov. 15, 1976, Tennessee Valley Authority, (photograph taken by TVA employee, Abby Bender, 2000), previously submitted.

* cited by examiner

SEGMENTAL FLOATING BULKHEAD ASSEMBLY

BACKGROUND OF THE INVENTION

1. Field of the Invention

The present invention relates generally to a bulkhead assembly for dewatering water passages of dams and, more particularly, to a floating bulkhead assembly and, most particularly, to a segmental floating bulkhead assembly for this purpose.

2. Background Information

The standard means for dewatering dam intakes and outlets, such as spillways, outlet works, penstocks and draft tubes, has been with bulkhead assemblies or stop logs placed in opposing slots set in the passageway walls. A bulkhead assembly is a one-piece fabrication that is positioned across the water passage opening in slots to allow the water passage to be dewatered without having to lower the reservoir. The bulkhead assembly is usually lowered into place from the top of the dam with a mobile crane, gantry crane or permanent hoist. For large openings, where a one-piece bulkhead assembly is impractical, a series of horizontal bulkhead assemblies, called stop logs, are placed in the slots and stacked one on top of the next, using the same type of lifting devices used for the one-piece bulkhead assemblies. Bulkhead assemblies and stop logs are made from timber, aluminum or stainless steel for small passages, but larger openings mandate steel fabrications. When not in use, the bulkhead assemblies or stop logs are suspended above the water passage or placed in a dry storage location.

The use of buoyancy for bulkhead assemblies to reduce or eliminate the need for hoists or cranes is known. Older floating bulkhead assemblies often were one-piece steel fabrications used at site-specific intakes and stored permanently in the reservoir or removed with a large capacity crane after use. These bulkhead assemblies are designed similar to a ship. The floating bulkhead assembly's bottom is filled with ballast to keep it upright, and the bulkhead assembly is partitioned into chambers that are flooded or purged to adjust the trim of the bulkhead assembly.

Many of these floating bulkhead assemblies are still in use. However, they are difficult to maneuver and operate, more costly to fabricate than conventional bulkhead assemblies, and expensive to maintain. If not maintained, floating bulkhead assemblies may be deemed unsafe to operate due to unknown conditions in the sealed chambers, internal steel corrosion or unreliable components.

Some examples of inventions concerned with bulkhead assemblies for which patents have been granted are found in the following: Mills, U.S. Pat. No. 5,634,742, and Tucker, U.S. Pat. No. 4,729,692. Additionally, various other designs have been used or considered as shown in the literature, including the Northern States Power Company and Ayres Associates hinged bulkhead assembly described in Trends, a Publication of Ayres Associates, "Dam Renovation—Hinged Floating Bulkhead Assembly Proves Flexible, Reusable", Autumn, 1987 ("Ayres Design"), and further described by Bakken and Vonasek in Proceedings: Small Hydro 1988, Ministry of Energy, Toronto, Canada, "Floating Bulkhead Assembly Installed for Hydro Intake Repair," July 1988 among others. However, these disclosed devices embody many of the shortcomings outlined above, resulting in a need for an economical, easily fabricated bulkhead assembly, which is readily handled without large, expensive equipment.

The Ayres Design, which utilizes wide flange steel beams, has several drawbacks compared to the use of hollow rectangular section steel tubes made from flat sheet. Fabrication using wide flange beams to create a workable caisson requires a great amount of skillful cutting and welding of the beams, which increases the cost of fabrication. Wide flange beams are not produced in many useable varieties or dimensions, and heavy customization is often required. This lack of variety also lessens the engineering options. With wide flange beams, the bottom chamber is generally required to be the sealable chamber of the caisson, which in turn, dictates or limits the engineering options for the size of the caisson. Bakken and Vonasek reference the drawbacks with the use of rolled rectangular tube sections as being quite heavy and, due to the limited depths available in rolled steel tubes, the anticipated deflections of the units at the bottom of the wall would be excessive and could potentially cause problems with the bottom seal. Also, a drawback of using large dimension tube sections, for instance, tube sections greater than approximately 0.7 meters wide, is the excess weight and cost. The device of the present invention meets these needs, while providing many additional features that are unique to the methods and structures described herein.

SUMMARY OF THE INVENTION

The present invention is directed to the structure of a floatable caisson member and to a segmental floatable bulkhead assembly formed by assembling a plurality of the floatable caisson members. The present invention also includes a method of fabrication of the floatable caisson member. Dewatering a water passage of a dam is achieved by employing a segmental floatable bulkhead assembly formed by assembling a plurality of the floatable caisson members.

In one embodiment of the invention, the floatable caisson member includes at least two hollow, rectangular section, HSS steel tubes made from flat sheet steel, each tube sealed at each end by a tube end plate to form at least two sealed chambers. A side plate is secured to the at least two steel tubes, with the at least two steel tubes and the side plate defining at least one intermediate space. At least one pair of intermediate space end plates is secured between adjacent tubes of the at least two tubes. At least one intermediate chamber plate is secured to the at least two steel tubes opposite the side plate. The intermediate chamber plate seals at least a portion of the at least one intermediate space to create at least another sealed chamber. At least one sealed chamber includes at least one sealable aperture to selectively flood the sealed chamber and to evacuate water from the sealed chamber. The sealed chambers may be selectively flooded and evacuated to effectuate the desired submersion, installation and removal of the floatable caisson member from the water passage of a dam.

One method of fabrication of the floatable caisson member includes the steps of providing at least two hollow, rectangular section, HSS steel tubes and connecting the tubes in parallel with a side plate, with the tubes and side plate defining at least one intermediate space. The at least two tubes are sealed with tube end plates to form at least two sealed chambers. At least a portion of the at least one intermediate space is sealed to create at least another sealed chamber. At least one sealed chamber includes at least one sealable aperture to selectively flood the sealed chamber and to evacuate water from the sealed chamber. The chambers may be selectively flooded and evacuated to effectuate desired submersion, installation and removal of the caisson member from the water passage of a dam.

Another embodiment of the present invention includes a bulkhead assembly for dry isolation of a water passage of a dam. The bulkhead assembly comprises a plurality of floatable caisson members bound together to form a platform assembly adapted to float in a horizontal attitude on a water body surface. At least one of the caisson members includes at least two HSS steel tubes connected in parallel with a side plate, the HSS tubes and the side plate defining at least one intermediate space. The at least two tubes are sealed with tube end plates to form at least two sealed chambers, and at least a portion of the at least one intermediate space is sealed to create at least another sealed chamber, with at least one of the sealed chambers including at least one sealable aperture to selectively flood the sealed chamber and to evacuate water from the sealed chamber to cause the bulkhead selectively to move between the horizontal attitude and a vertical attitude in the water body, and selectively to reduce and increase buoyancy of the bulkhead assembly. At least one of the floatable caisson members includes a sealable conduit for selectively permitting flow of water from the water body through the bulkhead assembly.

The invention also comprises one method for isolating a water passage of a dam from a body of water, including the steps of providing a plurality of floatable caisson members adapted for binding together to form a single, panel bulkhead assembly that floats in a horizontal attitude on a water body surface. At least one of the caisson members includes at least two HSS steel tubes connected in parallel with a side plate, the HSS tubes and the side plate defining at least one intermediate space. The at least two tubes are sealed with tube end plates to form at least two sealed chambers, and at least a portion of the at least one intermediate space is sealed to create at least another sealed chamber, with at least one of the sealed chambers including at least one sealable aperture to selectively flood the sealed chamber and evacuate water from the sealed chamber. The floatable caisson members are connected together to form a rigid, single panel bulkhead assembly adapted to float in horizontal attitude on the surface of the body of water. At least one of the sealed chambers is flooded to cause the bulkhead assembly to move from the horizontal attitude to a vertical attitude in the body of water. The bulkhead assembly is moved in the vertical attitude to a position contacting water passage piers. The bulkhead assembly is held against the piers, and at least a further of the at least one sealed chambers is flooded to reduce buoyancy of the bulkhead assembly to cause the bulkhead assembly to sink to the sill of the water passage. Water from an area behind the bulkhead assembly is then evacuated.

The invention also comprises another method for isolating a water passage of a dam from a body of water, including the steps of providing a plurality of floatable caisson members adapted for rotatably binding together to form a segmental bulkhead assembly that floats in a horizontal attitude on a water body surface. At least one of the caisson members includes at least two HSS steel tubes connected in parallel with a side plate, the HSS tubes and the side plate defining at least one intermediate space, the at least two tubes sealed with tube end plates to form at least two sealed chambers, with at least a portion of the at least one intermediate space sealed to create at least another sealed chamber, and with at least one of the sealed chambers including at least one sealable aperture to selectively flood the sealed chamber and evacuate water from the sealed chamber.

At least two of the floatable caisson members are rotatably connected together to form a rotatable, segmental bulkhead assembly adapted to float in the horizontal attitude on the surface of the body of water. The bulkhead assembly is moved in the horizontal attitude to a position adjacent water passage piers, with one caisson member floating adjacent the water passage and one caisson member floating opposite the water passage. At least one sealed chamber of the bulkhead assembly caisson member adjacent the water passage is flooded to cause the caisson member to move from the horizontal attitude to a submerged vertical attitude in the body of water. The flooding step is repeated for selected sealed chambers of selected floating caisson members to move that caisson member to a submerged vertical attitude, causing the segmental bulkhead assembly to sink to the sill of the water passage. Water from an area behind the segmental bulkhead assembly is then evacuated.

The above summary of the present invention is not intended to describe each illustrated embodiment or every implementation of the present invention. The figures and detailed description that follow more particularly exemplify these embodiments.

BRIEF DESCRIPTION OF THE DRAWINGS

The invention may be more completely understood in consideration of the following detailed description of various embodiments of the invention in connection with the accompanying drawings, in which.

Figure 1:
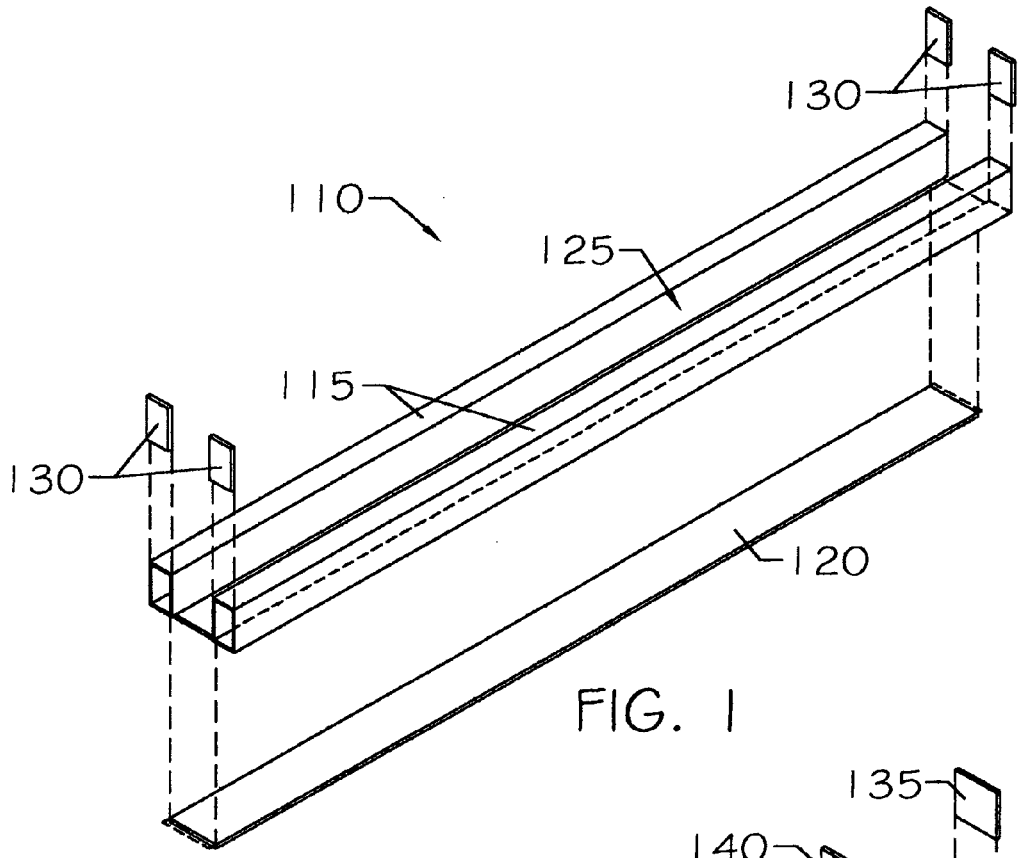
FIG. 1 shows a perspective view of one step in the fabrication of one embodiment of the floatable caisson member of the present invention.

While the invention is amenable to various modifications and alternative forms, specifics thereof have been shown by way of example in the drawings and will be described in detail. It should be understood, however, that the intention is not necessarily to limit the invention to the particular embodiments described. On the contrary, the intention is to cover all modifications, equivalents, and alternatives falling within the spirit and scope of the invention, as defined by the appended claims.

DESCRIPTION OF THE EMBODIMENTS

The present invention is directed to a floatable caisson member for use with a bulkhead assembly for dry isolation of water passages of a dam. In one embodiment of the invention, the floatable caisson member includes at least two hollow, rectangular section, HSS steel tubes made from flat sheet steel, each tube sealed at each end by a tube end plate to form at least two sealed chambers. A side plate is secured to the at least two steel tubes, with the at least two steel tubes and the side plate defining at least one intermediate space. At least one pair of intermediate space end plates is secured between adjacent tubes of the at least two tubes. At least one intermediate chamber plate is secured to the at least two steel tubes opposite the side plate. The intermediate chamber plate seals at least a portion of the at least one intermediate space to create at least another sealed chamber. At least one sealed chamber includes at least one sealable aperture to selectively flood the sealed chamber and evacuate water from the sealed chamber. At least one of the sealed chambers is selectively flooded and evacuated to effectuate the desired submersion, installation and removal of the floatable caisson member from a water passage of a dam.

One method of fabrication of the floatable caisson member includes the steps of providing at least two hollow, rectangular section, HSS steel tubes and connecting the tubes in parallel with a side plate, with the tubes and side plate defining at least one intermediate space. The at least two tubes are sealed with tube end plates to form at least two sealed chambers. At least a portion of the at least one intermediate space is sealed to create at least another sealed chamber. At least one sealed chamber includes at least one sealable aperture to selectively flood the sealed chamber and evacuate water from the sealed chamber. At least one of the sealed chambers is selectively flooded and evacuated to effectuate desired submersion, installation and removal of the caisson member from water passage of a dam.

There are five general criteria for individual caisson members that assemble to form a segmental bulkhead assembly for water passage control during dam or gate repairs.

1. Each caisson member floats or sinks dependent upon the amount of water it contains.
2. The caisson member structure must resist the maximum hydraulic pressures encountered in all contemplated applications.
3. The caisson member structure must be water tight with no unintended air or water leakage.
4. The caisson member structure must provide for controlled addition and removal of water ballast to prevent sudden or uncontrolled movement of the caisson member structure during installation and removal.
5. The caisson member structure must be of suitable size and strength for portability between points of use.

Referring to FIGS. 1–12, several embodiments of the floatable caisson member device of the present invention are shown. The structural features of the floatable caisson member of the present invention are best understood by describing the fabrication of such a floatable caisson member. The method of fabrication of the floatable caisson member is also unique and comprises one facet of the present invention.

Figure 2:
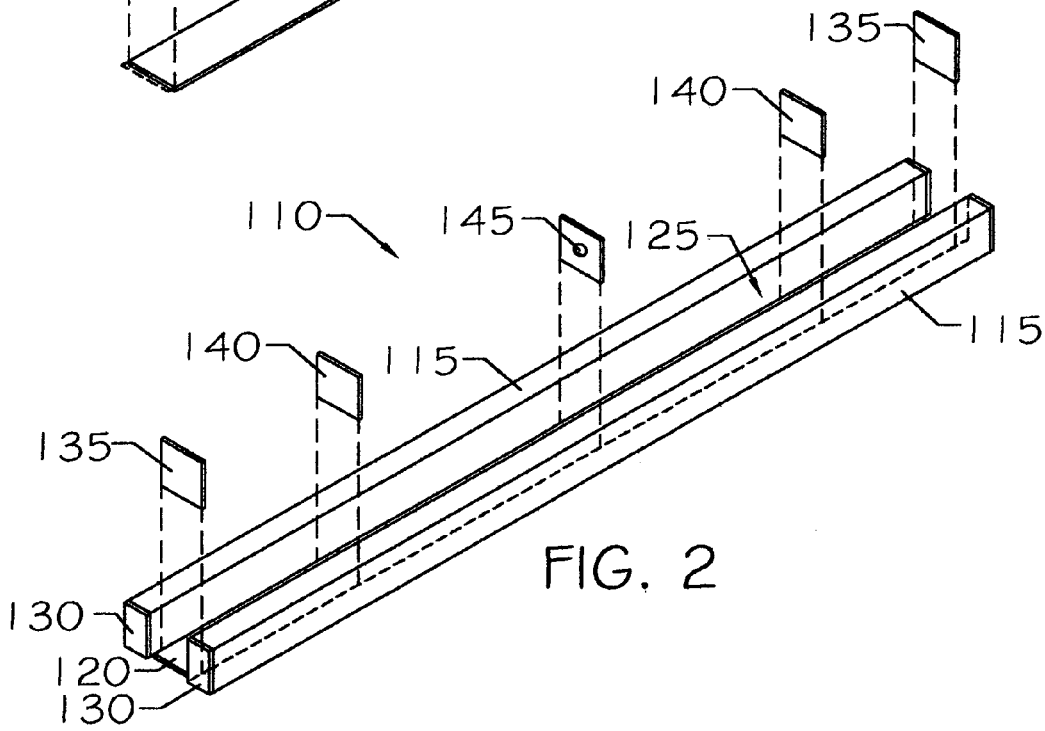
FIG. 2 shows a perspective view of another step in the fabrication of one embodiment of the floatable caisson member of the present invention.
Figure 3:
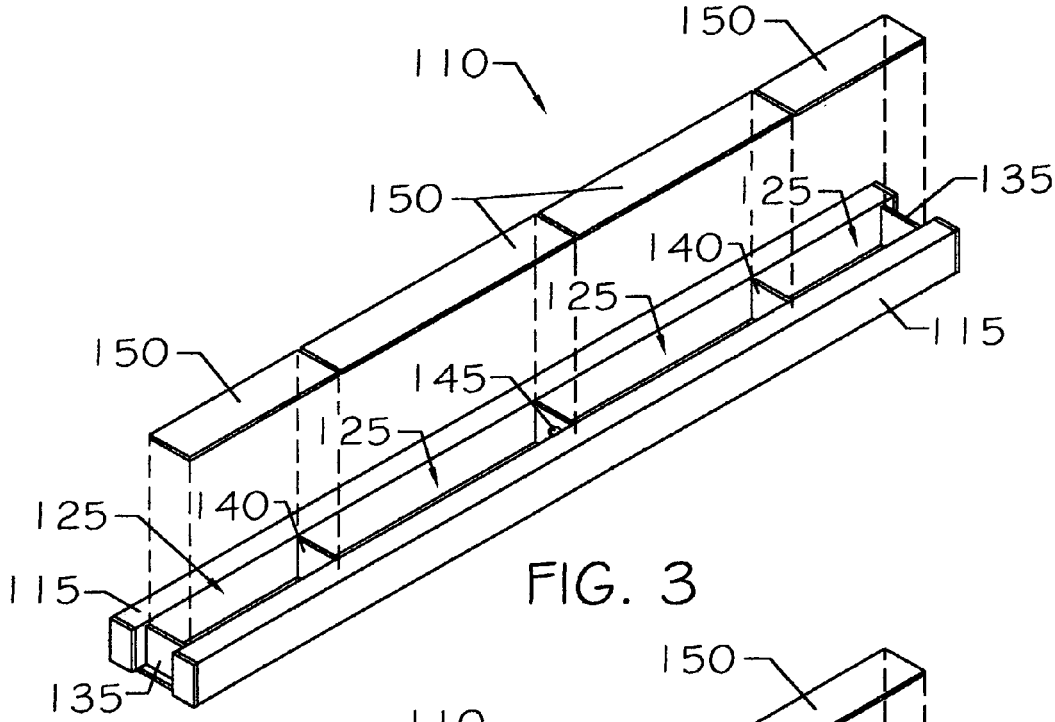
FIG. 3 shows a perspective view of another step in the fabrication of one embodiment of the floatable caisson member of the present invention.

Referring now to FIGS. 1–3, the fabrication of one embodiment of the floatable caisson member 110 includes the steps of providing at least two hollow, rectangular section, steel tubes 115. These tubes are known as Hollow Structural Section (HSS) tubes that are fabricated by bending flat sheet steel, preferably by utilizing a Form-Square Weld-Square Process, or a Submerged Arc Weld Process, which is also known as the Brake Form Process. This embodiment is illustrated with two HSS steel tubes 115, but three or more HSS steel tubes 115 can be included with equivalent results. The HSS steel tubes 115 are preferably fabricated with a step of bending flat steel sheet that has a thickness sufficient to provide the structural characteristics required for use in a floatable caisson member 110. The HSS steel tubes 115 have a length sufficient to span a water opening of a dam, so that a bulkhead assembly made from a plurality of floatable caisson members 110 can isolate the water opening from a body of water. The HSS steel tubes 115 are preferably of equal length and of similar rectangular section.

A side plate 120 is fastened or joined, preferably by welding, to the at least two HSS steel tubes 115, with the at least two HSS steel tubes 115 and the side plate 120 defining at least one intermediate space 125, which has a rectangular cross section. In this embodiment, the side plate 120 extends between adjacent edges of the parallel HSS steel tubes 115. The side plate 120 is secured, preferably by welding, to the adjacent edges of each HSS steel tube 115, as shown in FIGS. 1 and 2. The HSS steel tubes 115 are sealed with end plates 130 so that the sealed HSS tubes 115 become chambers to selectively hold and release air. At least one pair of intermediate space end plates 135 is secured between adjacent HSS tubes 115. The intermediate space end plates 135 may be positioned anywhere within the intermediate space or at the end positions of the intermediate space, however, are preferably installed short of the ends of each HSS tube 115, as illustrated in FIGS. 2 and 3, such that the end plates 135 also function as diaphragms between the HSS tubes 115 and impart improved structural integrity to the floatable caisson member 110. Installing end plates 135 in such a recessed manner also eases the structural fastening of end plates 135 and fabrication of caisson member 110. Installing at least one intermediate chamber plate 150 to the tubes 115 opposite the side plate 120 seals the intermediate space to provide at least one additional sealed chamber. The intermediate chamber plate 150 may extend the length of the tubes 115, but preferably more than one plate 150 is utilized. Tubes 115 become sealed when joined with tube end plates 130 to become sealed chambers, and space 125 (or a portion thereof), is also sealed such that space 125 becomes a sealed chamber. Thus, reference made herein to a sealed chamber is reference made to a sealed tube 115 or a sealed space 125 (or portion thereof), or both.

In a further embodiment of the invention, at least one diaphragm 140 is installed within the intermediate space 125 to subdivide the space 125, as illustrated in FIG. 2, where three such diaphragms 140 are installed. Installing at least one intermediate chamber plate 150 to the tubes 115 opposite the side plate 120 seals the intermediate space 125 to provide at least one additional sealed chamber. Preferably, the intermediate chamber plate 150 is secured, preferably by welding, to the adjacent tube edges of the intermediate space 125 opposite the side plate 120. As illustrated in FIG. 3, where the intermediate spaces 125 includes three diaphragms 140, the resulting four intermediate chambers 125 are sealed with four intermediate chamber plates 150. Each of the four intermediate spaces 125 may therefore be configured as sealable, intermediate chambers or sealed intermediate sub-chamber portions. One or more diaphragms 140 may include an opening 145 that provides fluid communication between adjacent sealed intermediate chambers. The opening 145 may be a central aperture or selectively designed with slots or openings. The chamber plates 150 are secured, preferably by welding to the end plate 135 and the diaphragm 140, as well as to the adjacent tube edges, to seal the intermediate space 125.

Figure 4:
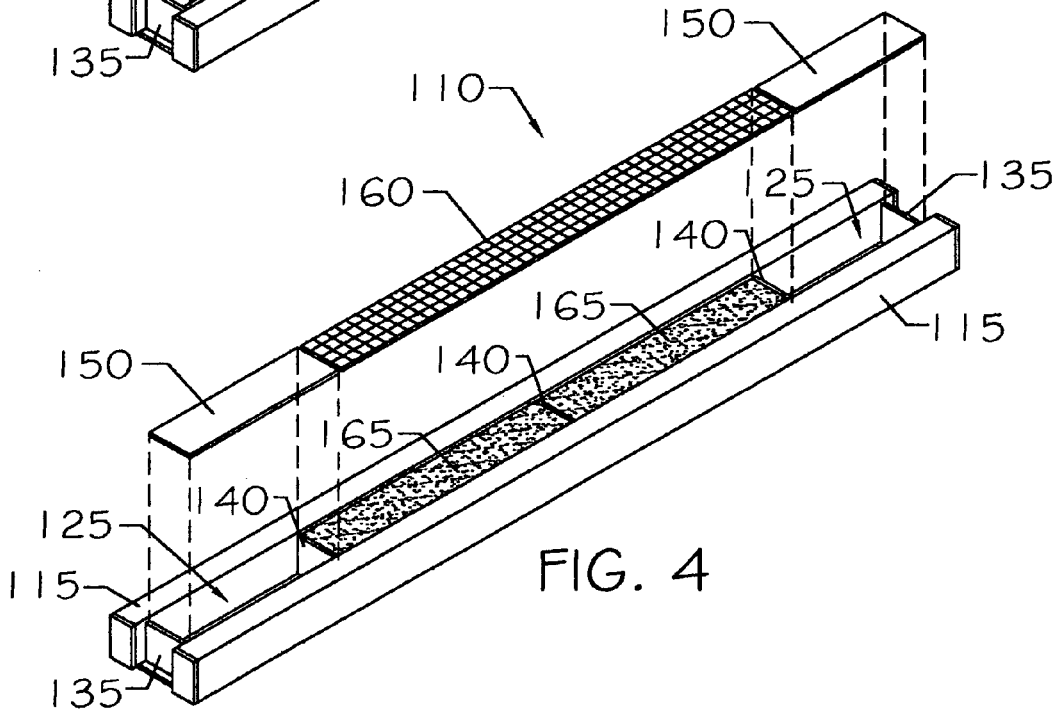
FIG. 4 shows a perspective view of an alternative step in the fabrication of one embodiment of the floatable caisson member of the present invention.

An alternative embodiment of the invention disclosed in FIGS. 1–3 is shown in FIG. 4. Referring to FIG. 4, the caisson member's intermediate space 125 is divided into four subchambers by three diaphragms 140, as described above. The two end subchambers are sealed by securing, preferably by welding an intermediate chamber plate 150 to the tube edges, the intermediate space end plate 135, and one diaphragm 140. The interior intermediate subchambers are covered only by intermediate chamber cover screens 160, leaving a void that fills with water upon submersion of the floatable caisson member. In a further embodiment, shown in FIG. 4, the interior, intermediate subchamber voids beneath the cover screens 160 are filled with buoyant foam material 165 to exclude water from the voids, thereby adjusting the buoyancy of the floatable caisson member 110.

Further aspects of the previous embodiments are described later with respect to a completed caisson such as that shown in FIG. 9A.

Figure 5:
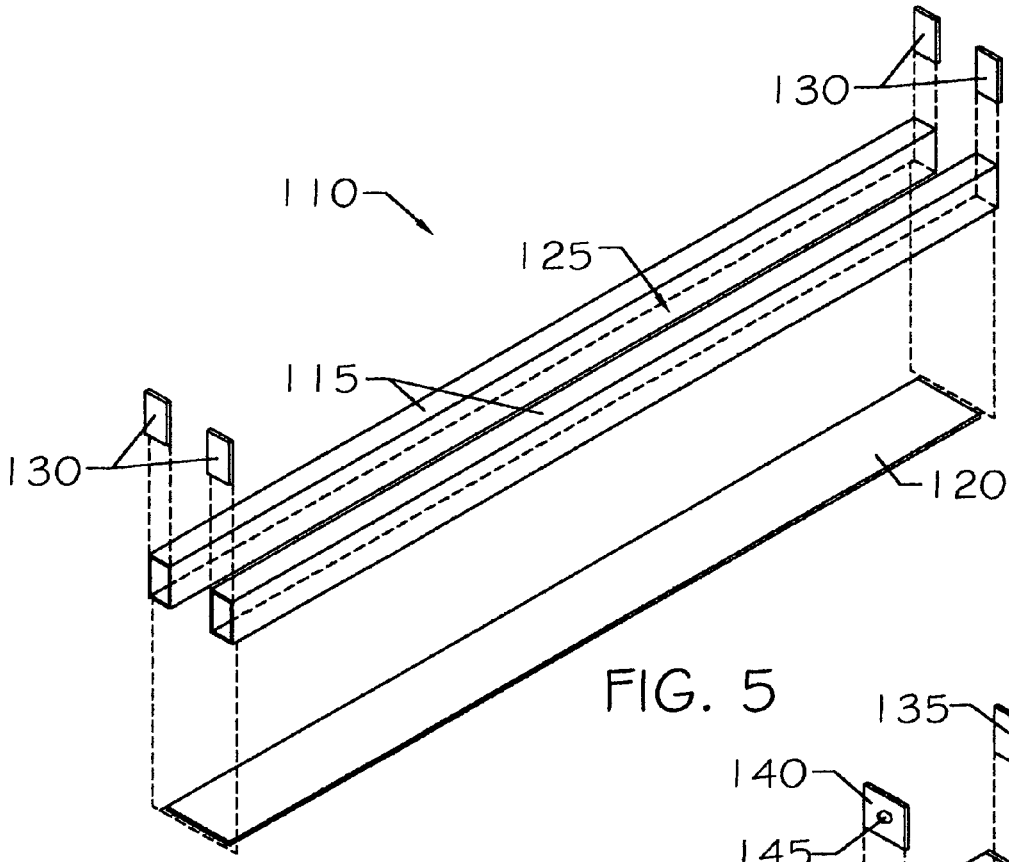
FIG. 5 shows a perspective view of one step in the fabrication of another embodiment of the floatable caisson member of the present invention.
Figure 6:
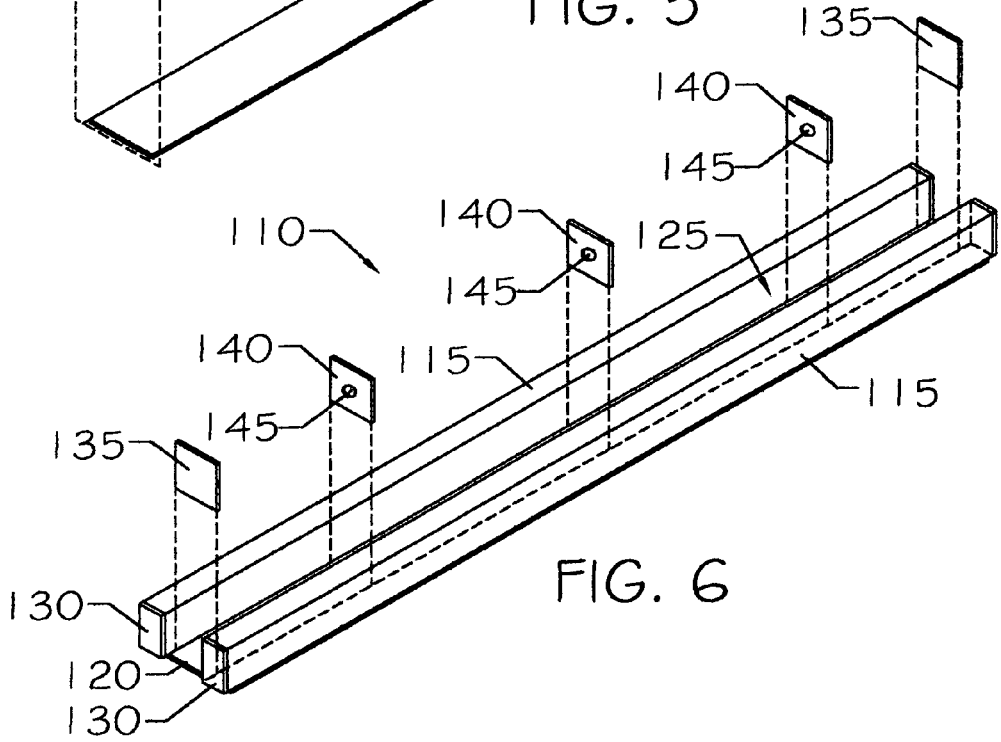
FIG. 6 shows a perspective view of another step in the fabrication of the embodiment of FIG. 5 of the floatable caisson member of the present invention.
Figure 7:
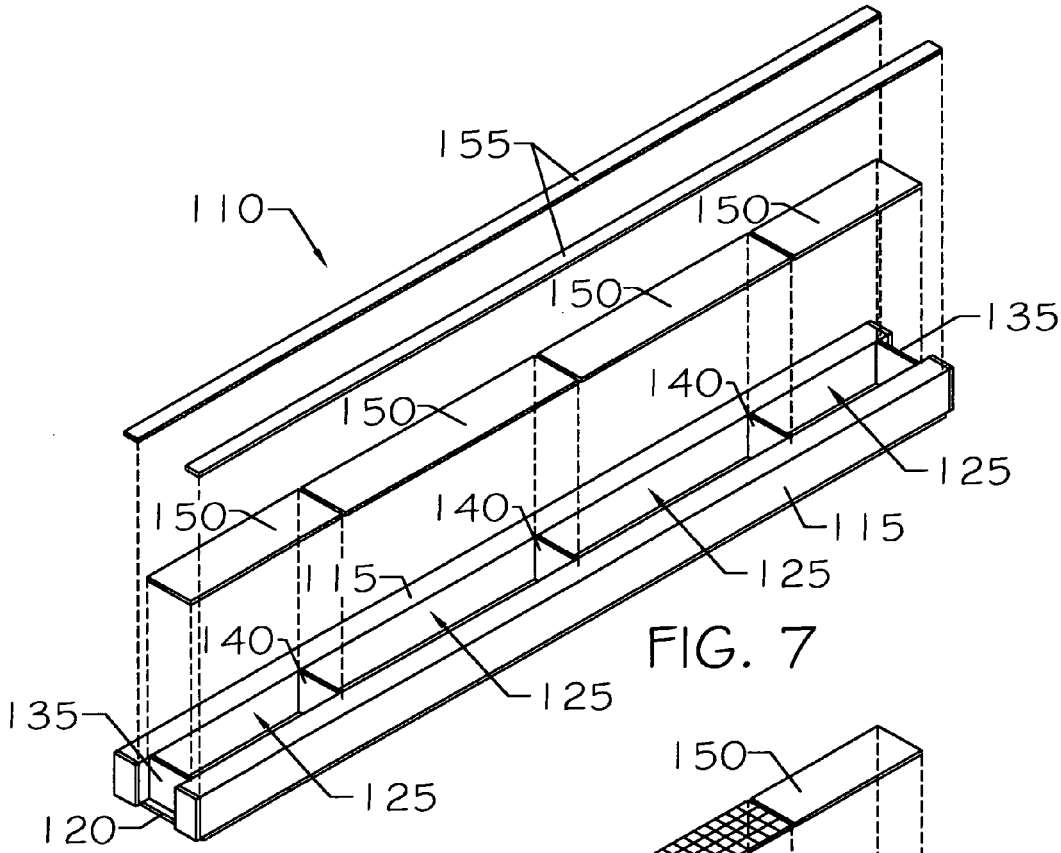
FIG. 7 shows a perspective view of a further step in the fabrication of the embodiment of FIG. 5 of the floatable caisson member of the present invention.

Referring now to FIGS. 5–7, the fabrication of another embodiment of the floatable caisson member 110 includes the steps of providing at least two hollow, rectangular section, steel tubes 115. These tubes are known as Hollow Structural Section (HSS) tubes that are fabricated by the processes described in detail above. Again, this embodiment is illustrated with two HSS steel tubes 115, but three or more HSS steel tubes 115 can be included with equivalent results. The HSS steel tubes 115 are preferably fabricated with a step of bending flat steel sheet that has a thickness sufficient to provide the structural characteristics required for use in a floatable caisson member 110. The HSS steel tubes 115 have a length sufficient to span a water opening of a dam, so that a bulkhead assembly made from a plurality of floatable caisson members 110 can isolate the water opening from a body of water. The HSS steel tubes 115 are preferably of equal length and of similar rectangular section.

A side plate 120 is secured to the at least two HSS steel tubes 115, with the at least two HSS steel tubes 115 and the side plate 120 defining at least one intermediate space 125, which has a rectangular cross section. The side plate 120 extends essentially the full width of the parallel HSS steel tubes 115 positioned thereon. This allows both adjacent and opposite edges of each HSS steel tube positioned on the side plate 120 to be secured, preferably by welding, thereto, as shown in FIGS. 5 and 6. In this embodiment, the side plate 120 also functions as tube cover plates, providing additional structural integrity for the caisson member 110. The HSS steel tubes 115 are sealed with end plates 130 so that the sealed HSS tubes 115 become chambers to selectively hold and release air. At least one pair of intermediate space end plates 135 is secured between adjacent HSS tubes 115. The intermediate space end plates 135 may be positioned anywhere within the intermediate space or at the end positions of the intermediate space, however, end plates 135 are preferably installed short of the ends of each HSS tube 115, as illustrated in FIGS. 6 and 7, such that the end plates 135 also function as diaphragms between the HSS tubes 115 and impart improved structural integrity to the floatable caisson member 110. Installing end plates 135 in such a recessed manner also eases the structural fastening of end plates 135 and fabrication of caisson member 110.

In a further embodiment of the invention, at least one diaphragm 140 is installed within the intermediate space 125 to subdivide the space 125, as illustrated in FIG. 6, where three such diaphragms 140 are installed. Installing at least one intermediate chamber plate 150 to the tubes 115 opposite the side plate 120 seals the intermediate space 125 to provide at least one additional sealed chamber. Preferably, the intermediate chamber plate 150 is secured to the adjacent tube edges of the intermediate space 125 opposite the side plate 120. As illustrated in FIG. 7, where the intermediate spaces 125 includes three diaphragms 140, the resulting four intermediate spaces 125 are sealed with four intermediate chamber plates 150. Each of the four intermediate spaces 125 may therefore be configured as sealable, intermediate chambers or sealed intermediate subchamber portions. One or more diaphragms 140 may include an opening 145 that provides fluid communication between adjacent, sealed, intermediate chambers. The aperture 145 may be a central aperture or selectively designed with slots or openings. The chamber plates 150 are secured, preferably by welding, to the end plate 135 and the diaphragm 140, as well as to the adjacent tube edges to seal the intermediate space 125. In addition, tube cover plates 155 may be secured to the tube 115 sides adjacent the intermediate chamber plates 150 for additional structural integrity, as illustrated in FIG. 7. Thus, each tube cover plate 155 is secured to a surface of one HSS steel tube 115, opposite the side plate 120.

Figure 8:
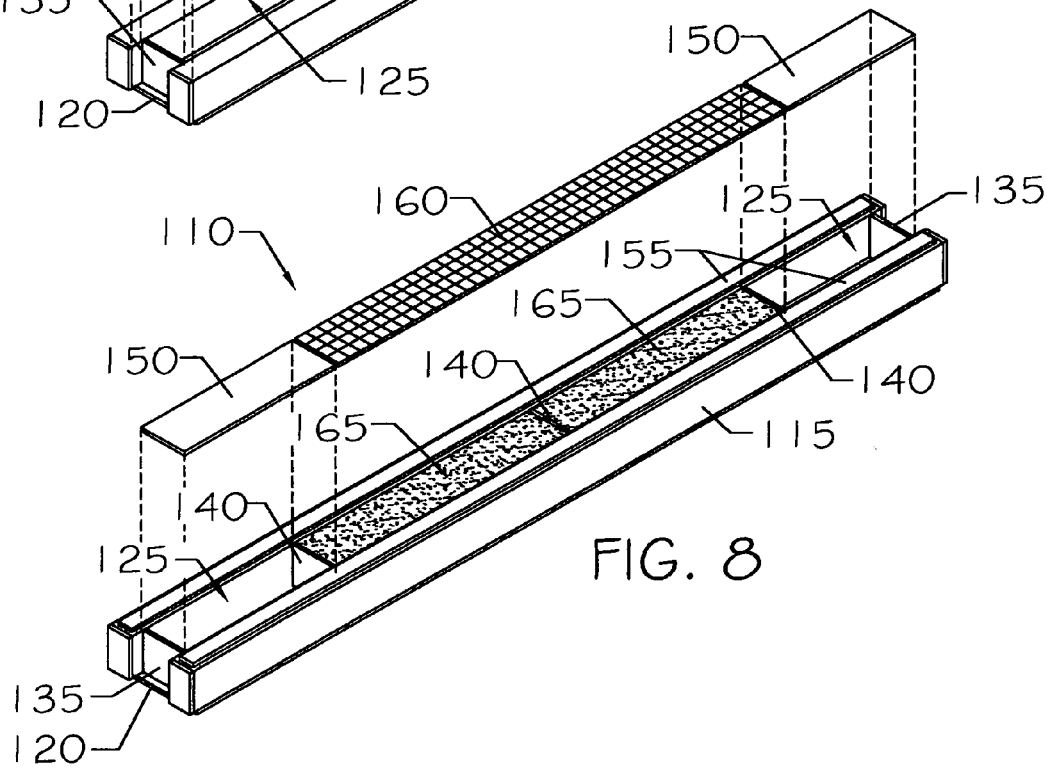
FIG. 8 shows a perspective view of an alternative step in the fabrication of the embodiment of FIG. 5 of the floatable caisson member of the present invention.

An alternative embodiment of the invention disclosed in FIGS. 5–7 is shown in FIG. 8. Referring to FIG. 8, the caisson member's intermediate space 125 is divided into four subchambers by three diaphragms 140, as described above. The two end subchambers are sealed by securing, preferably by welding, an intermediate chamber plate 150 to the tube edges, the intermediate space end plate 135, and one diaphragm 140. The interior intermediate subchambers are covered only by intermediate chamber cover screens 160, leaving a void that fills with water upon submersion of the floatable caisson member. In a further embodiment, shown in FIG. 8, the interior, intermediate subchamber voids beneath the cover screens 160 are filled with buoyant foam material 165 to exclude water from the voids, thereby adjusting the buoyancy of the floatable caisson member 110.

Further aspects of the previous embodiments are described later with respect to a completed caisson such as that shown in FIG. 9B.

The use of hollow rectangular section (HSS) tubes made from flat sheet material accommodates easier and less expensive caisson fabrication, simplified caisson installation and a variety of engineering options. The HSS tubes 115 can be custom fabricated and sized to fit a particular application, whereas the wide flange beams are available only in set sizes. The wide flange member's flange edges must be butted together to form sealed chambers requiring expensive edge preparation, a difficult partial penetration butt weld that leaves an interior seam that weakens the joint and leaves a location to initiate corrosion The caisson fabrication method does not require personnel access for fabrication as do structures shown in some references. A further advantage of applicant's invention is the use of HSS tubes 115, configured with a cover plate 155 to provide additional structural integrity for the caisson member 110.

Figure 9A:
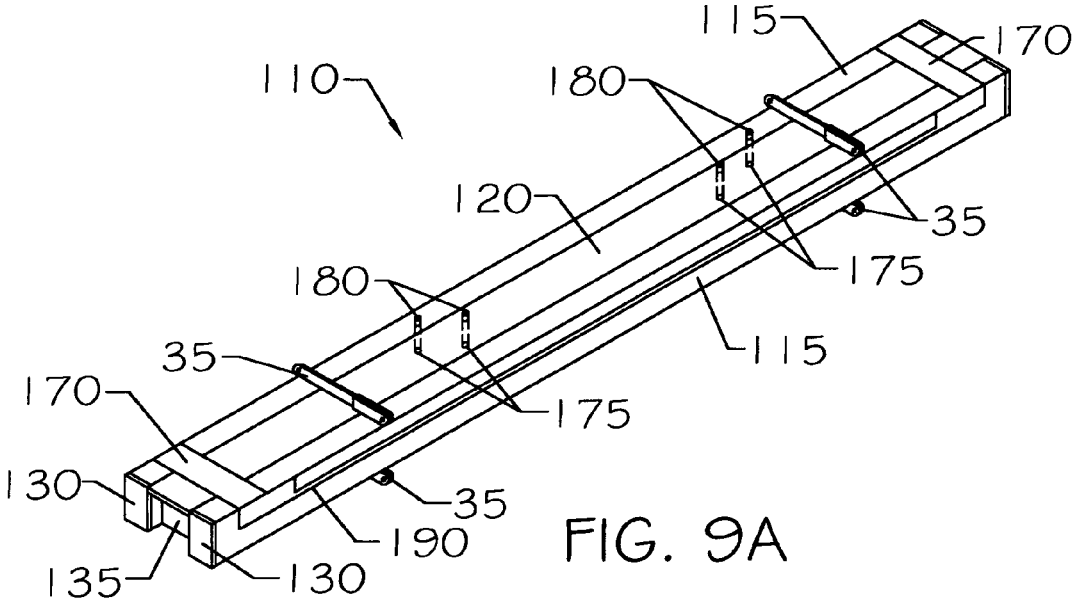
FIG. 9A shows a perspective view of another step in the fabrication of the embodiment of FIG. 1 of the floatable caisson member of the present invention.
Figure 9B:
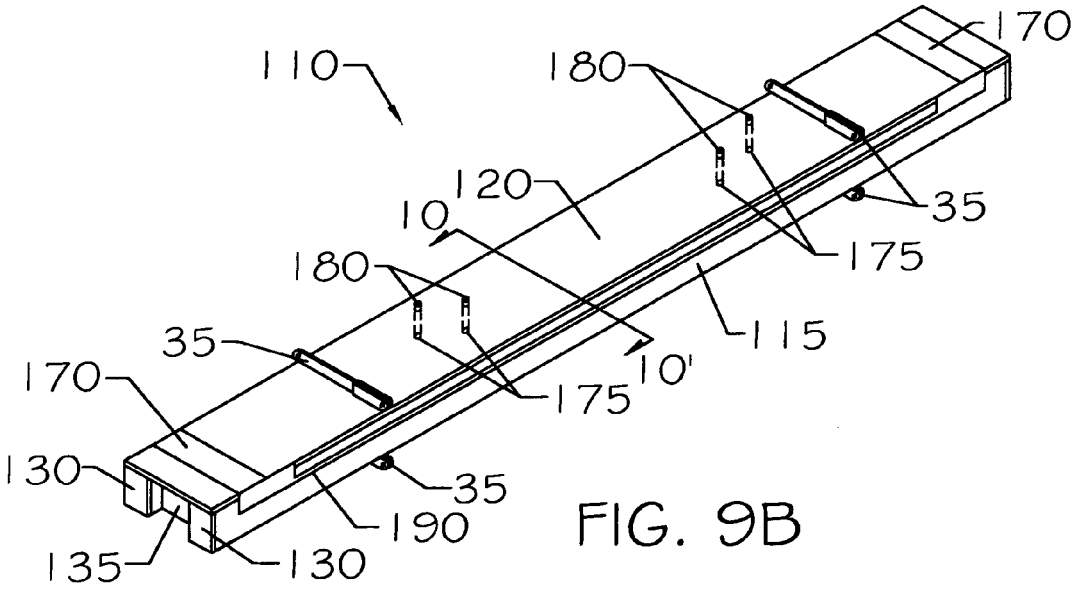
FIG. 9B shows a perspective view of another step in the fabrication of the embodiment of FIG. 5 of the floatable caisson member of the present invention.

Referring now to FIGS. 9A and 9B, fully assembled floatable caisson members 110 are shown. The structure shown in FIG. 9A corresponding to the structure shown in the embodiments described earlier concerning FIGS. 1–3. The structure shown in FIG. 9B corresponds to the structures shown in the embodiments described earlier concerning FIGS. 5–7. The sealed, intermediate space 125 and/or an HSS steel tube 115, includes a means for controlling air and water entry and exit from at least one sealed chamber of the floatable caisson member 110. For example, the sealed, intermediate space 125 is provided with at least one sealable aperture 175 for controlling air and water entry and exit therefrom. At least one aperture 175 is provided to selectively flood the sealed chamber (either the intermediate space 125 or portion thereof, or a steel tube 115), and to evacuate water from the sealed chamber. The sealable apertures 175 preferably include corresponding plugs 180 that are preferably manually inserted or removed to control air and water entry and exit.

In addition to use of plugs 180, aperture 175 may also include a valve as means for controlling air and water entry. It is also appreciated that a hose or tube from a water pump (not shown) or air compressor (not shown), for instance, may be associated with the aperture 175, such that the water pump or air compressor operate as means for controlling air and water entry.

The floatable caisson member 110 includes a plurality of fastening devices 35 installed on at least one exterior surface of the caisson member 110. Preferably, a pair of spaced apart fastener devices 35 is installed on each of two opposed exterior surfaces of the caisson member 110, as illustrated in FIGS. 9A and 9B. The fastening devices are preferably planar members that extend perpendicularly across the width of the caisson member 110. The fastening devices 35 have fastener openings 40 at each end thereof, with a slot at one fastener end to accept the planar fastener member 35 from another caisson member 110. Pins, bolts or turnbuckles (not shown) inserted through the mated fastener openings 40, secure adjacent caisson members 110 together. At least one rotatable fastening device 310 (see FIG. 12), for instance, may be secured to the exterior surface of the caisson member 110 for assembling a bulkhead assembly made of rotatable caisson members.

Figure 10:
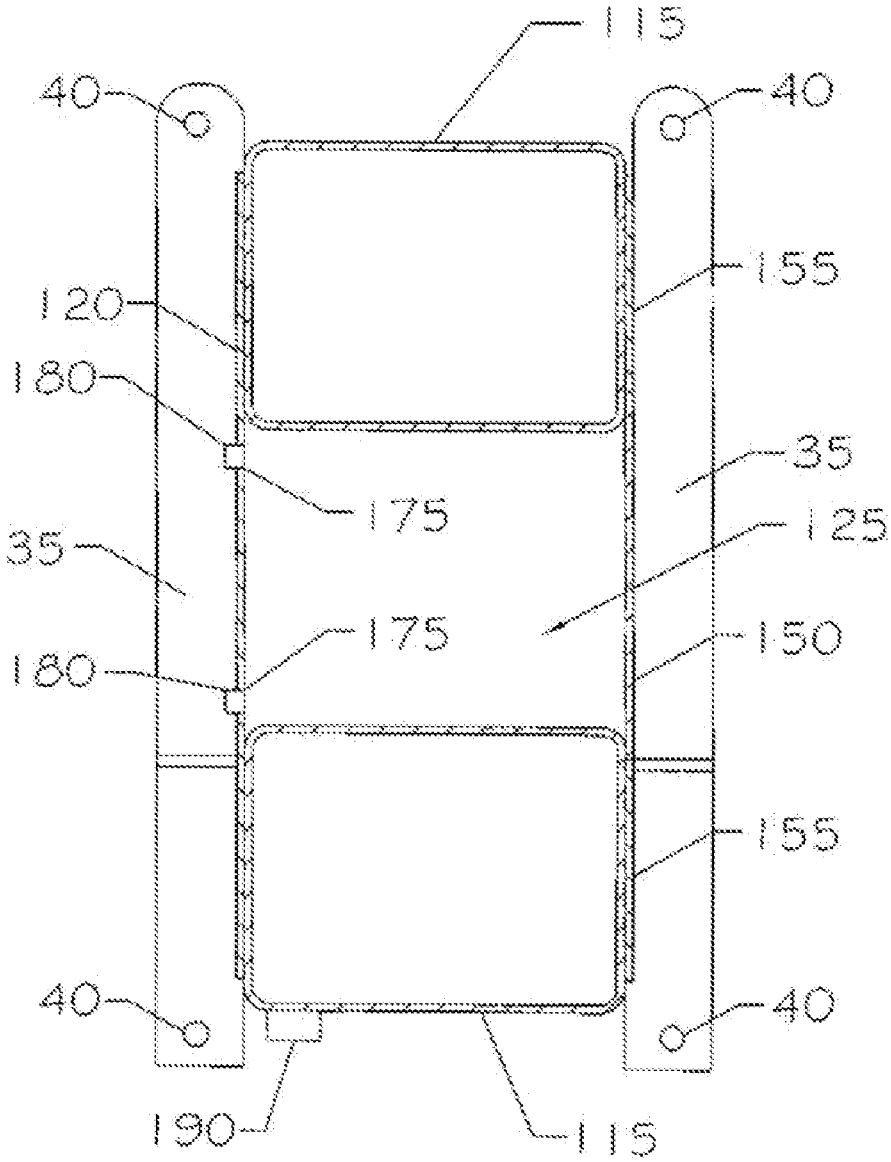
FIG. 10 shows a cross sectional view along line 10–10' of FIG. 9B.

A cross sectional view of the floatable caisson member 110 is shown in FIG. 10, where the caisson member side plate 120 extends to opposite edges of the HSS steel tubes 115 and both an intermediate chamber plate 150 and tube cover plates 155 are present. Additionally, a seal 190 extends substantially the length of one said at least two HSS steel tubes 115, the seal forming a watertight joint between adjacent, joined, floatable caisson members 110. An adjustable seal 170 (see FIGS. 9A, 9B and 11) also extends across the width of the caisson member 110 at both ends. This seal 170 abuts the face of the dam and/or a pier nose 340 (see FIG. 12) adjacent the water passage with the caisson member 110 in place. Seal 170 may be relocated on floatable caisson members 110 for different water passage opening spans. A bottom seal 192 (see FIG. 11) may be positioned on at least one caisson member 110 for forming a water tight joint between the caisson member 110 and sill 335, seat or structure face of the dam. Seals 170 and 192 accordingly engage the water passage structures such as the sill 335, pier nose 340, and dam face (not shown).

Figure 11:
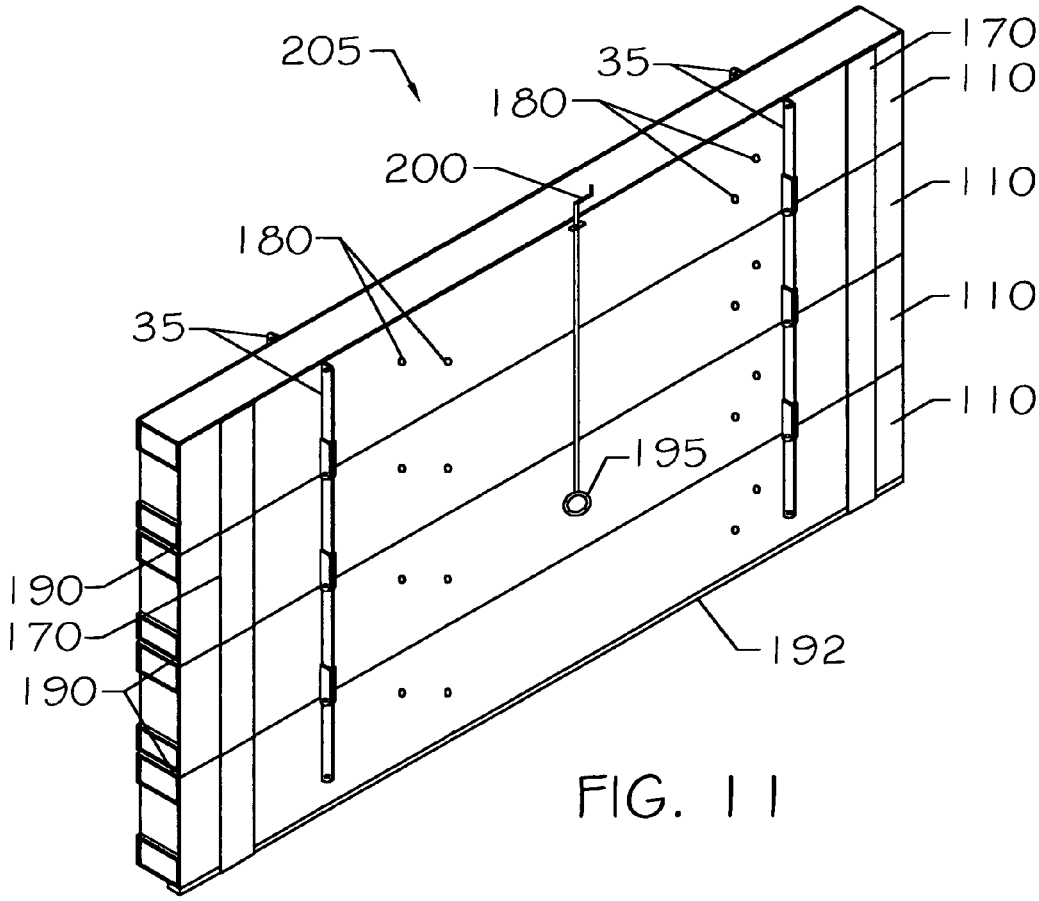
FIG. 11 shows a segmental floatable bulkhead assembly made from a plurality of floatable caisson members of the present invention and configured in a vertical attitude.

Referring now to FIG. 11, a unique segmental floating bulkhead assembly 205 is shown. The bulkhead assembly 205 consists of a plurality of individual, floatable caisson members 110, described in detail above, connected together on the upstream side and, optionally as shown, also on the downstream side. Preferably, each floatable caisson member 110 consists of three or more sealed horizontal chambers with a selected chamber used to vary the buoyancy of the bulkhead assembly 205. The floatable caisson members 110 are constructed of steel tube sections and plate, as described above, to form the various chambers, thereby simplifying fabrication, mitigating internal corrosion, and reducing manufacturing costs. Sealable apertures 175 are covered with corresponding plugs 180 that are manually inserted and removed to control air and water entry and exit to cause the bulkhead selectively to move between a horizontal attitude (not shown) and a vertical attitude (see FIG. 11). Additionally, water and air conduit means such as water hoses and air hoses may be assembled (not shown) to connect with aperture 175 for obtaining fluid communication with a selected one or more of the caissons 110. Preferrably, apertures 175 are manually sealable, but it may be appreciated that apertures 175 may be sealed non-manually. A sealable conduit 195 (see FIG. 11) is provided in at least one of the floatable caisson members 110 for selectively permitting flow of water from the water body through the bulkhead assembly 205. An extended valve handle 200 activates opening and closing of conduit 195.

In a further embodiment of the present invention, a method for isolating a water passage of a dam from a body of water is disclosed. The method includes the steps of providing a plurality of floatable caisson members 110 bound together to form a rigid, panel bulkhead assembly 205, adapted to float in a horizontal attitude on a water body surface. At least one of the caisson members 110 include at least two HSS steel tubes 115 connected in parallel with a side plate 120, the HSS tubes 115 and the side plate 120 defining at least one intermediate space 125, with the at least two tubes 115 sealed with tube end plates 130 to form at least two sealed chambers, and at least a portion of the at least one intermediate space 125 sealed to create at least another sealed chamber, with at least one of the sealed chambers including at least one aperture 175 to selectively flood the sealed chamber and evacuate water from the sealed chamber. The floatable caisson members 110 are connected together to form a bulkhead assembly 205, adapted to float in a horizontal attitude on the surface 325 of the body of water. At least one of the sealed chambers within at least one of the floatable caisson members 110 is flooded to cause the bulkhead assembly 205 to move from the horizontal attitude to a vertical attitude in the body of water. The bulkhead assembly 205 is moved in the vertical attitude to a position contacting water passage piers. The bulkhead assembly 205 is held against the piers, and selectively flooding of at least a further of said at least one sealed chambers occurs to reduce buoyancy of the bulkhead assembly 205 to cause the bulkhead assembly 205 to sink to the sill of the water passage. Water from an area between the dam gate and the bulkhead assembly 205 is then evacuated.

Additional details of the above method include the following. Each floatable caisson member 110 is placed on the reservoir and pinned together on the upstream side, as well as fastened together by turnbuckles (not shown) on the downstream side, to form a rigid, unitary bulkhead assembly 205. Sealable apertures 175 positioned on the downstream face of selected, floatable caisson members 110 are opened to allow reservoir water to flood the caisson member's selected chamber. Opening an aperture 175 at each end of the bottom caisson member 110, for instance, floods the selected chamber to initiate descent of the bulkhead assembly 205 as a unitary structure. As the bulkhead assembly moves from a horizontal to a vertical position, the various open apertures 175 in the other, floatable caisson members 110 fill with water to provide ballast, much like the keel of a ship. No air compressors or water pumps are needed for installation, in contrast to prior floating bulkhead assemblies. Further, the buoyant force is distributed among the various floatable caisson members 110 so that high strength rods are not needed to tie the caisson members 110 together. Additionally, the bulkhead assembly 205 of the present invention does not require hoists or rigging to control the descent of the caisson members 110, as with certain other segmented bulkhead assemblies (Ayres Design).

Once in the vertical position, the bulkhead assembly 205 is moved to the dam water passage to be dewatered. The bulkhead assembly 205 is lowered to the dam sill, seat or structure face by opening apertures 175 in another caisson member's selected chamber until the bulkhead assembly 205 is positioned properly. The water passage of the dam is drained to seat the submerged bulkhead assembly 205 against the water passage structures, such as the sill 335, pier nose 340 or dam face. Water drains from the ballasted, selected chambers via apertures 175 on the caisson member's downstream side, as the water passage is emptied. The downstream chamber apertures 175 are closed after draining, except for those needed for ballasting during removal of the bulkhead assembly 205. In the vertical, floating position, before it is seated, the bulkhead assembly 205 can be moved from one water passage to another without bringing the bulkhead assembly 205 to a horizontal attitude, provided the reservoir pool is sufficiently deep.

Gate 315 (see FIG. 12) may be returned to operation when bulkhead assembly 205 is moved from the water passage. Water is evacuated from at least one of the sealed chambers and at least one aperture 175 is sealed to prevent flooding of the chamber. The area A between the dam gate and the bulkhead assembly 205 is flooded to allow the bulkhead assembly to float off the water passage sill 335, preferably by opening sealable conduit 195. The bulkhead assembly 205 may also be moved from the pier nose 340, dam face or water passage. Additional selected sealed chambers may also be evacuated and sealed to allow the bulkhead assembly 205 to move from the vertical attitude to the horizontal floating attitude. The caisson members 110 may be disconnected from each other and removed from the body of water for dry storage.

Figure 12:
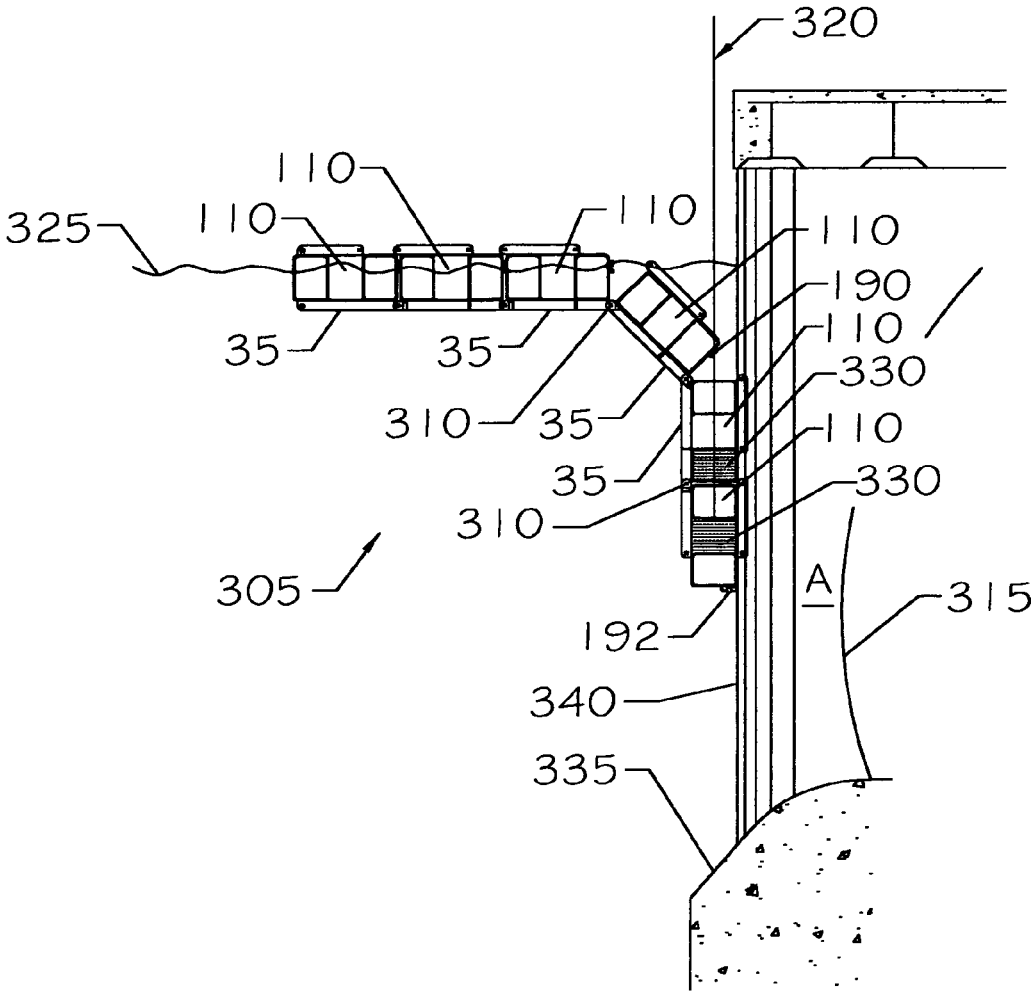
FIG. 12 shows a segmental floatable bulkhead assembly of the present invention during installation, using the rotatably connected method.

In a further embodiment of the present invention, another method for isolating a water passage of a dam from a body of water is disclosed. Referring to FIG. 12, the segmental floating bulkhead assembly 305 is shown during installation at a water passage. The method includes the steps of providing a plurality of floatable caisson members 110 adapted for rotatably binding together to form a segmental bulkhead assembly that floats in a horizontal attitude on a water body surface. At least one of the caisson members 110 includes at least two HSS steel tubes 115, connected in parallel with a side plate 120, with the HSS tubes 115 and the side plate 120 defining at least one intermediate space 125. The at least two tubes 115 are sealed with tube end plates 130 to form at least two sealed chambers, with at least a portion of the at least one intermediate space 125 sealed to create at least another sealed chamber. At least one of the sealed chambers includes at least one sealable aperture 175 to selectively flood the sealed chamber and evacuate water from the sealed chamber. Allowing for the selection of any one of the sealed chambers to be configured to selectively hold and release air provides for a variety of design and engineering options. For instance, selecting the intermediate chamber allows engineers to alter the dimensions of the caisson member and other caissons.

At least two of the floatable caisson members 110 are rotatably connected together to form a rotatable, segmental bulkhead assembly 305 adapted to float in a horizontal attitude on the surface 325 of the body of water. The bulkhead assembly 305 is moved in the horizontal attitude to a position adjacent the water passage piers 340 or water passage structure, with one caisson member 110 floating adjacent the water passage and one caisson member 110 floating opposite the water passage structure. Piers 340 and sill 335 define the water passage. A hoist 320 is connected to each end of the caisson member 110 floating adjacent to the water passage structure. At least one sealed chamber of the bulkhead assembly caisson member 110, which is adjacent the water passage, is flooded and the caisson member 110 is lowered with the hoist 320 to cause the caisson member 110 to move from the horizontal attitude to a submerged, vertical attitude in the body of water. The flooding step is repeated for selected sealed chambers of selected floating caisson members 110 adjacent the water passage and the caisson member 110 is lowered with hoist 320 to move the selected caisson members 110 to a submerged vertical attitude, causing the segmental bulkhead assembly 305 to sink to the sill of the water passage, seat or structure face. Water from an area A between the dam gate 315 and the segmental bulkhead assembly 305 is then evacuated.

When the segmental, floating bulkhead assembly 305 requires removal, the hoist line 320 is removed from the bulkhead assembly 305. Water is evacuated from at least one of the sealed chambers sufficient to allow the bulkhead assembly 305 to float off the sill 325 of the water passage. At least one of the caisson member chamber valves or apertures 175 are then sealed or closed to prevent flooding of the at least one sealed chamber. The water passage gate 315 is closed and at least one sealable bypass conduit 195 located in at least one caisson member 110 is opened to allow reservoir water to fill the water passage. Bypass conduit 195 may be manually sealed or un-sealed with handle 200 to effective desired flooding of space A. It may be appreciated that a variety of valves may be used for sealing and un-sealing conduit 195. The segmental floating bulkhead assembly 305 rises slowly along the piers once water pressure is equalized between the reservoir and the previously emptied water passage area A. Water is evacuated from one or more caisson members 110 and one or more caisson members is re-sealed until each of the caisson members are moved from the vertical attitude to the horizontal floating attitude. Since the floatable caisson members 110 can rotate about the hinge pins on the upstream side, as each floatable caisson member 110 approaches the surface, buoyant forces causes the caisson members 110 to pivot about the connecting pins 310, positioning the downstream side of each caisson member 110 upward. No hoists, cranes or other heavy rigging are required to float the bulkhead assembly 305. The bulkhead assembly 305, which is now in a horizontal orientation, can be converted to a unitary structure by reconnecting the fasteners 35 between adjacent caisson members 110. This task is readily accomplished, since the unfastened bulkhead assembly side is atop the floating bulkhead assembly 305. The bulkhead assembly 305 is then moved to another water passage intake for installation, as described above. Should the segmental floating bulkhead assembly 305 require transport to a distant location or storage, the floatable caisson members 110 are disconnected, and each caisson member 110 is extracted from the reservoir.

This segmental, floatable bulkhead assembly 305 provides easy maneuverability and maximum flexibility, compared to other similar bulkhead assemblies. Only a few hours will be required to install or remove the segmental, floatable bulkhead assembly 305. Also, the need for divers to assist with installation and removal is minimized, thus providing additional cost savings.

Thus, the individual caisson members 110 that are assembled to form a segmental bulkhead assembly 305 meet the five general criteria for caisson members enumerated above. The present invention provides an improvement over existing caisson member structures, an improvement in the method of their fabrication and improvement in the methods of isolating a dam water passage from a body of water.

While the present invention has been described with reference to several particular example embodiments, those skilled in the art will recognize that many changes may be made thereto without departing from the spirit and scope of the present invention, which is set forth in the following claims.

I claim:

1. A bulkhead assembly for dry isolation of water passages of a dam, said bulkhead assembly comprising:

at least two floatable caisson members bound together to form a bulkhead assembly, at least one of said caisson members comprising:

at least two HSS steel tubes, at least one of said HSS steel tubes having a rectangular cross section;

at least one of said HSS tubes sealed to form at least one sealed chamber;

a side plate welded to said at least two HSS steel tubes, said at least two HSS steel tubes and said side plate defining at least one intermediate space between said at least two HSS steel tubes;

at least one pair of intermediate space end plates secured to said at least two HSS steel tubes and side plate within said at least one intermediate space;

at least one intermediate chamber plate secured to said at least two HSS steel tubes opposite said side plate, said intermediate chamber plate sealing at least a portion of said at least one intermediate space to create at least another sealed chamber; and at least one of said sealed chambers having at least one sealable aperture to selectively flood said sealed chamber.

2. The bulkhead assembly for dry isolation of water passages of a dam according to claim 1 further including at least one fastening device secured to an exterior surface of said at least one floatable caisson member for assembling said bulkhead assembly made of a selected number of floatable caisson members.

3. The bulkhead assembly for dry isolation of water passages of a dam according to claim 2 wherein said at least one fastening device allows adjacent caissons to rotate about their longitudinal axis.

4. The bulkhead assembly for dry isolation of water passages of a dam according to claim 1 further including a seal extending substantially the length of said at least two steel tubes, said seal adapted for forming a water tight joint between adjacent joined floatable caisson members.

5. The bulkhead assembly for dry isolation of water passages of a dam according to claim 1 further including at least one sealable conduit for selectively permitting flow of water from the water body through said bulkhead assembly.

6. The bulkhead assembly for dry isolation of water passages of a dam according to claim 1 further including at least one seal on an exterior surface for abutting a portion of a dam proximate the water passage.

7. The bulkhead assembly for dry isolation of water passages of a dam according to claim 1 wherein said at least one aperture includes means for controlling air and water entry and exit.

8. The bulkhead assembly for dry isolation of water passages of a dam according to claim 7 wherein said means for controlling air and water entry and exit includes one selected from the group consisting of a water pump, an air compressor, a plug, and a valve.

9. The bulkhead assembly for dry isolation of water passages of a dam according to claim 1 further including at least one tube cover plate secured to at least one tube opposite said side plate.

10. The bulkhead assembly for dry isolation of water passages of a dam according to claim 1 wherein said side plate covers at least a portion of at least one of said HSS tubes.

11. The floatable caisson member for use with a bulkhead assembly according to claim 1 wherein at least a portion of said at least one intermediate space is unsealed.

12. The floatable caisson member for use with a bulkhead assembly according to claim 11 wherein said unsealed portion of said at least one intermediate space is filled with buoyant foam material.

13. A floatable caisson member for use with a bulkhead assembly for dry isolation of water passages of a dam, the floatable caisson member comprising:

at least two HSS steel tubes, at least one of said HSS steel tubes having a rectangular cross section;

each HSS tube sealed at each end by a tube end plate to form at least two sealed chambers;

a side plate welded to said at least two HSS steel tubes, said at least two steel HSS tubes and said side plate defining at least one intermediate space between said at least two HSS steel tubes;

at least one pair of intermediate space end plates secured to said at least two HSS steel tubes and side plate within said at least one intermediate space;

at least one intermediate chamber plate secured to said at least two HSS steel tubes opposite said side plate, said intermediate chamber plate sealing at least a portion of said at least one intermediate space to create at least another sealed chamber;

at least one of said sealed chambers having at least one sealable aperture to selectively flood said sealed chamber and evacuate water from said sealed chamber;

whereby at least one of said sealed chambers may be selectively flooded and evacuated to effectuate desired submersion, installation and removal of said floatable caisson member from the water passage of a dam.

14. The floatable caisson member for use with a bulkhead assembly according to claim 13 further comprising at least one seal positioned on an exterior surface for abutting portions of a dam proximate the dam water passage.

15. The floatable caisson member for use with a bulkhead assembly according to claim 13 wherein, at least one diaphragm is secured to said at least two HSS steel tubes and said side plate within said at least one intermediate space.

16. The floatable caisson member for use with a bulkhead assembly according to claim 13 further comprising a tube cover plate secured to at least one of said at least two HSS steel tubes opposite said side plate.

17. The floatable caisson member for use with a bulkhead assembly according to claim 13 wherein, at least one of said intermediate space end plates is secured interior of adjacent tube ends of said at least two HSS steel tubes.

18. The floatable caisson member for use with a bulkhead assembly according to claim 13 wherein said at least one sealable aperture includes means for controlling air and water entry and exit.

19. The floatable caisson member for use with a bulkhead assembly according to claim 18 wherein said controlling means includes one selected from the group consisting of a water pump, an air compressor, a plug, and a valve.

20. The floatable caisson member for use with a bulkhead assembly according to claim 13 wherein, said member includes at least one diaphragm within said at least one intermediate space, said diaphragm secured to said at least two HSS steel tubes and said side plate, said at least one intermediate chamber plate has a length less than said tube length for sealing at least one intermediate sub-chamber portion of at least one intermediate space.

21. The floatable caisson member for use with a bulkhead assembly according to claim 13 wherein at least a portion of said at least one intermediate space is unsealed.

22. The floatable caisson member for use with a bulkhead assembly according to claim 21 wherein said unsealed portion of said at least one intermediate space is filled with buoyant foam material.

23. The floatable caisson member according to claim 13 wherein said at least two HSS steel tubes are of substantially equal length and aligned in parallel.

24. The floatable caisson member according to claim 13 wherein said side plate is of a length substantially equal to the length of one of the at least two HSS steel tubes.

25. The floatable caisson member according to claim 13 wherein said side plate covers a portion of at least one of said at least two HSS steel tubes.

26. The floatable caisson member for use with a bulkhead assembly according to claim 13 further including at least one sealable conduit for selectively permitting flow of water from the water body through said bulkhead assembly.

27. The floatable caisson member for use with a bulkhead assembly according to claim 15 wherein, said at least one diaphragm includes an opening.

28. A method for isolating a water passage of a dam from a body of water comprising the step of providing at least one caisson member according to claim 13.

29. The method according to claim 28 further comprising:

flooding at least one of said sealed chambers to cause at least a portion of said caisson to move from the horizontal attitude to a vertical attitude in the body of water;

moving said caisson to a position contacting the water passage structure; and evacuating water from the water passage behind said caisson.

30. A floatable caisson member for use with a bulkhead assembly for dry isolation of water passages of a dam, the floatable caisson member comprising;

at least two HSS steel tubes, at least one of said HSS steel tubes having a rectangular cross section;

at least one of said HSS steel tubes sealed at each end by a tube end plate to form at least one sealed chamber within said at least one HSS steel tube;

a side plate welded to said at least two HSS steel tubes, said at least two HSS steel tubes and said side plate defining at least one intermediate space between said at least two HSS steel tubes;

at least one pair of intermediate space end plates secured to said at least two HSS steel tubes and to said side plate within said at least one intermediate space;

said at least one HSS steel tube having at least one sealable aperture to selectively flood said at least one sealed chamber and evacuate water from said at least one sealed chamber;

whereby said at least one sealed chamber may be selectively flooded and evacuated to effectuate desired submersion, installation and removal of said floatable caisson member from a water passage of a dam.

31. The floatable caisson member for use with a bulkhead assembly according to claim 30 wherein said at least two HSS steel tubes are of substantially equal length and aligned in parallel.

32. The floatable caisson member for use with a bulkhead assembly according to claim 30 wherein said side plate is of a length substantially equal to the length of one of the at least two HSS steel tubes.

33. The floatable caisson member for use with a bulkhead assembly according to claim 30 wherein, said side plate covers a portion of at least one of said at least two HSS steel tubes.

34. The floatable caisson member for use with a bulkhead assembly according to claim 30 wherein, at least one diaphragm is secured to said at least two HSS steel tubes and side plate within said at least one intermediate space.

35. The floatable caisson member for use with a bulkhead assembly according to claim 30 wherein, at least one of said intermediate space end plates is secured interior of adjacent tube ends of said at least two HSS steel tubes.

36. The floatable caisson member for use with a bulkhead assembly according to claim 30 wherein said member further includes at least one intermediate chamber plate secured to said at least two HSS steel tubes opposite said side plate, said intermediate chamber plate sealing at least a portion of said at least one intermediate space to create at least another sealed chamber.

37. The floatable caisson member for use with a bulkhead assembly according to claim 30 further comprising a tube cover plate secured to at least one of said at least two HSS steel tubes opposite said side plate.

38. The floatable caisson member for use with a bulkhead assembly according to claim 34 wherein, said at least one diaphragm includes an opening.

39. The floatable caisson member for use with a bulkhead assembly according to claim 30 further comprising at least one fastening device secured to an exterior surface of said floatable caisson member for assembling a bulkhead assembly made of a selected number of caisson members.

40. The floatable caisson member for use with a bulkhead assembly according to claim 39 wherein said at least one fastening device allows adjacent caissons to rotate about their longitudinal axis.

41. The floatable caisson member for use with a bulkhead assembly according to claim 30 further comprising a seal extending substantially the length of said at least two HSS steel tubes, said seal adapted for forming a water tight joint between adjacent joined floatable caisson members.

42. The floatable caisson member for use with a bulkhead assembly according to claim 30 further comprising a seal on an exterior surface for abutting portions of a dam proximate the dam water passage.

43. The floatable caisson member for use with a bulkhead assembly according to claim 30 wherein at least a portion of said at least one intermediate space is unsealed.

44. The floatable caisson member for use with a bulkhead assembly according to claim 43 wherein said unsealed portion of said at least one intermediate space is filled with buoyant foam material.

45. The floatable caisson member for use with a bulkhead assembly according to claim 30 wherein said at least one sealable aperture includes means for controlling air and water entry and exit.

46. The floatable caisson member for use with a bulkhead assembly according to claim 45 wherein said means for controlling air and water entry and exit includes one selected from the group consisting of a water pump, an air compressor, a plug, and a valve.

47. The floatable caisson member for use with a bulkhead assembly according to claim 34 wherein said member includes at least one intermediate chamber plate, said at least two HSS steel tubes, said side plate, and said at least one diaphragm define at least another sealed chamber within said at least one intermediate space.

48. The floatable caisson member for use with a bulkhead assembly according to claim 30 further including at least one sealable conduit for selectively permitting flow of water from a water body through said bulkhead assembly.

49. A bulkhead assembly for dry isolation of water passages of a dam, said bulkhead assembly comprising at least one floatable caisson member according to claim 30.

50. A bulkhead assembly according to claim 49 further including at least one sealable conduit to selectively permit flow of water from a water body through said bulkhead assembly.

51. A bulkhead assembly according to claim 49 wherein at least a portion of said at least one intermediate space is unsealed.

52. A bulkhead assembly according to claim 51 wherein said unsealed portion of said at least one intermediate space is filled with buoyant foam material.

53. A method for isolating a water passage of a dam from a body of water comprising the step of providing at least one caisson member according to claim 30.

54. The method according to claim 53 further comprising:

flooding said at least one sealed chamber to cause at least a portion of said caisson to move from the horizontal attitude to a vertical attitude in the body of water;

moving said caisson to a position contacting the water passage structure; and evacuating water from the water passage behind said caisson.

55. A floatable caisson for isolation of water passages of a dam, the floatable caisson comprising:

at least two HSS steel tubes, at least one of said HSS steel tubes having a rectangular cross section;

at least one of said HSS tubes sealed to form at least one sealed chamber within said at least one HSS steel tube;

a side plate welded to said at least two HSS steel tubes, said at least two HSS steel tubes and said side plate defining at least one intermediate space between said at least two HSS steel tubes; and said at least one HSS steel tube having at least one sealable aperture.

56. A floatable caisson according to claim 55 wherein said caisson further includes at least one pair of intermediate space end plates secured to said at least two HSS steel tubes within said at least one intermediate space.

57. A floatable caisson according to claim 56 wherein said intermediate space end plates are secured to said side plate.

58. A floatable caisson according to claim 55 wherein said caisson includes at least another sealed chamber, at least one of said sealed chambers may be selectively flooded and evacuated.

59. A method for isolation of a water passage of a dam comprising the step of providing at least one floatable caisson according to claim 55.

60. The method according to claim 59 further comprising:

flooding said at least one sealed chamber to cause at least a portion of said caisson to move from the horizontal attitude to a vertical attitude in the body of water;

moving said caisson to a position contacting the water passage structure; and evacuating water from the water passage behind said caisson.

61. A floatable caisson for dry isolation of water passages of a dam, the floatable caisson comprising:

at least two HSS steel tubes, at least one of said HSS steel tubes having a rectangular cross section;

a side plate welded to said at least two HSS steel tubes, said at least two HSS steel tubes and said side plate defining at least one intermediate space between said at least two HSS steel tubes;

at least one of said intermediate space and said at least two HSS steel tubes sealed to form a sealed chamber; and at least one sealable aperture in communication with said sealed chamber, said sealable aperture having a removable seal.

62. The floatable caisson of claim 61 wherein said removable seal includes one selected from the group consisting of a plug, a valve, a water pump, and an air compressor.

63. The floatable caisson of claim 61 wherein said sealed chamber is defined in part by at least one of said HSS tubes sealed to form at least one sealed chamber within said at least one HSS steel tube.

64. A floatable caisson according to claim 61 wherein said sealed chamber is defined in part by at least one pair of intermediate space end plates secured to said at least two HSS steel tubes and to said side plate within said at least one intermediate space.

65. A floatable caisson according to claim 61 wherein said sealed chamber is defined in part by at least one intermediate chamber plate secured to said at least two HSS steel tubes opposite said side plate, said intermediate chamber plate sealing at least a portion of said at least one intermediate space to create at least another sealed chamber.

66. A floatable caisson for dry isolation of water passages of a dam, the floatable caisson comprising:

at least two HSS steel tubes, at least one of said HSS steel tubes having a rectangular cross section;

a side plate welded to said at least two HSS steel tubes, said at least two steel HSS tubes and said side plate defining at least one intermediate space between said at least two HSS steel tubes;

at least one of said intermediate space and said at least two HSS steel tubes sealed to form a sealed chamber; and at least one sealable aperture in communication with said sealed chamber, said sealable aperture having a valve.

67. A floatable caisson according to claim 66 wherein said sealed chamber is defined in part by at least one of said HSS tubes sealed to form at least one sealed chamber within said at least one HSS steel tube.

68. A floatable caisson according to claim 66 wherein said sealed chamber is defined in part by at least one pair of intermediate space end plates secured to said at least two HSS steel tubes and to said side plate within said at least one intermediate space.

69. A floatable caisson according to claim 66 wherein said sealed chamber is defined in part by at least one intermediate chamber plate secured to said at least two HSS steel tubes opposite said side plate, said intermediate chamber plate sealing at least a portion of said at least one intermediate space to create at least another sealed chamber.

70. A floatable caisson according to claim 66 wherein said valve is permanently affixed to said caisson and is in communication with said sealed chamber.

* * * * *